US007064661B2

(12) United States Patent
Luode et al.

(10) Patent No.: US 7,064,661 B2
(45) Date of Patent: Jun. 20, 2006

(54) SYSTEM FOR CONTROLLING AND DETERMINING LOCATION AND SECURITY MODEL

(76) Inventors: Seppo Luode, Väinö länkatu 64, FIN-15230, Lahti (FI); Keijo Kantoluoto, Harilantie 185, FIN-17510, Nyystölä (FI); Kauko Valtonen, Autokatu 6, FIN-20380, Turku (FI)

( * ) Notice: Subject to any disclaimer, the term of this patent is extended or adjusted under 35 U.S.C. 154(b) by 301 days.

(21) Appl. No.: 10/311,247

(22) PCT Filed: Jun. 13, 2001

(86) PCT No.: PCT/FI01/00559

§ 371 (c)(1),
(2), (4) Date: Dec. 13, 2002

(87) PCT Pub. No.: WO01/97190

PCT Pub. Date: Dec. 20, 2001

(65) Prior Publication Data

US 2003/0156029 A1 Aug. 21, 2003

(30) Foreign Application Priority Data

Jun. 13, 2000 (FI) ..... 20001400

(51) Int. Cl.
*G08B 1/08* (2006.01)

(52) U.S. Cl. ..... 340/539.21; 340/541; 340/572.1

(58) Field of Classification Search ..... 340/539.21, 340/426.1, 541, 572.1, 825.49; 455/39, 404.2, 455/421, 456.1; 379/38, 39
See application file for complete search history.

(56) References Cited

U.S. PATENT DOCUMENTS 4,023,138 A * 5/1977 Ballin ..... 180/287
4,792,796 A * 12/1988 Bradshaw et al. ..... 340/539.21
4,814,751 A * 3/1989 Hawkins et al. ..... 340/573.1
4,918,425 A * 4/1990 Greenberg et al. ..... 340/539.3
4,998,095 A 3/1991 Shields ..... 340/574
5,200,735 A 4/1993 Hines ..... 340/539
5,223,815 A * 6/1993 Rosenthal et al. ..... 340/539.21

(Continued)

FOREIGN PATENT DOCUMENTS

EP 0 574 230 12/1993

(Continued)

OTHER PUBLICATIONS

Ericsson Review, vol. 3, 1998, Haartsen, Jaap, "Bluetooth—the universal radio interface for ad hoc, wireless connectivity", abstract.

*Primary Examiner*—Phung T. Nguyen
(74) *Attorney, Agent, or Firm*—Stites & Harbison PLLC; Marvin Petry

(57) ABSTRACT

A control and detection system for control of an object connected to the system, and for detection of object location in case of disappearance, theft or shifting of object, whereby the system has communication from each object at least to one data receiving device (3), (6) and from there data transmission (7) to the control unit. The system comprises an active short range transmitter that can be activated for function, furnished with a code of its own and placed in an object in the control area, a safety module monitoring the presence of the transmitter placed in an object in the area and/or detects a sender arriving to the area, base station of communication with connection to the control centre and the safety module.

13 Claims, 1 Drawing Sheet

U.S. PATENT DOCUMENTS

| | | | | |
|---|---|---|---|---|
| 5,319,698 | A | 6/1994 | Glidewell et al. | 379/39 |
| 6,297,737 | B1 * | 10/2001 | Irvin | 340/571 |
| 6,317,049 | B1 * | 11/2001 | Toubia et al. | 340/573.4 |
| 6,366,216 | B1 * | 4/2002 | Olesen | 340/825.49 |
| 2001/0002211 | A1 | 5/2001 | Lee | 379/414 |

FOREIGN PATENT DOCUMENTS

| | | |
|---|---|---|
| GB | 2 218 245 | 11/1989 |
| WO | WO 97/13230 | 4/1997 |
| WO | WO 99/46923 | 9/1999 |
| WO | WO 01/52517 | 7/2001 |

* cited by examiner

Control and detecting system is based on that that each flat is forming a cell with the following properties:

SYSTEM FOR CONTROLLING AND DETERMINING LOCATION AND SECURITY MODEL

FIELD OF THE INVENTION

The invention relates to a control and detection system for control of one or many objects connected to the system, and for detection of object location in case of disappearance, no matter for which reason, whereby the system has communication from each object at least to one data receiving device and from there data transmission to the control unit.

BACKGROUND OF THE INVENTION

Known among control systems is communication arranged from the controlled object along a conventional telephone line to the control unit, for instance. In the control object there can be many sensors to switch on the message/alarm connection, such as a motion detector, burglar alarm, smoke or heat detector, thanks to which connection is switched on to the control centre. The communication can include data regarding the nature of alarm.

A system of this kind is well suited for control of objects in a fixed location, for instance objects cabled to a unit in a building, from where there is, for instance, a phone line to the control centre. On limited areas the system is applicable to control of mobile objects only by means of special arrangements.

Known as detection systems there are systems based on RSSI bearing and systems based on GSM phone cell and GSM phone net. In these cases the detected object has to have a transmitter sending signals, a detectable GMS cell or such like. They have in common that the object of detection is actively taking part in the, while containing applications serving the detection.

The detection takes place on the area of GSM base stations that have received the signals sent by the GSM cell. If there are, simultaneously, several base stations on the range area, the detection can be better focused.

The disadvantage of these detection systems is great inaccuracy. At its best, it is possible to reach an accuracy only from 300 m to 3 km, which is rather insufficient.

SUMMARY OF THE INVENTION

By means of a control and detection system as per this invention a decisive improvement is reached both in the implementation of control and, also by the same system, an improvement of the efficiency of object detection, whereby the location of the object is most exactly detected. The control and detection system as per the invention is characterized in that the system comprises, placed in the object, an actively working short range transmitter, or one that can be activated to function, fitted with an own recognising code, a safety module i.e. a "Master" module observing or listening to the presence of the transmitter placed in the object and/or detects an approaching transmitter, further a base station for communication with connection to the control unit and connection to the safety module/listening radio device and in control, between safety module/listening radio device and the object a distance smaller than the communication range between them.

The safety module/listening radio device are characterized in that it includes a standard radio of short range, which has a transmitter/receiver and program controlling its function, at least by use of safety.

Other embodiments of this invention are represented in the dependent claims.

The advantage of the invention is that the objects to be controlled can be fixed and freely mobile. Even the fixed objects of the control area are free from cabling. To the objects in the system only a very small sized short range transmitter is fixed or hidden, for instance an ID detectable Blue-tooth type transmitter/receiver according to standard, the dimensions of which can be 10×10×2 mm and range 20 metres and price 50 FIM. It is easy to found the control system, for instance connecting the above-mentioned parts to the objects. A controllable unit formed of several objects form needs a supporting unit, which is in contact with the objects and, on the other hand, if needed, along the communication line in contact with some security with continuous duty.

By detection of a lost object the advantage is that almost in real time the security receives data of the location of the lost object, when it arrives in any control area of the same system.

The advantage of an embodiment of this invention is that detection is produced without developing for the object of detection any application to serve either the control or the detection functions. In the object of detection a radio transmitter with individual code (ID) is sufficient.

In addition, it is easy to include to the system a function to inactivate a disappeared object, for instance a stolen thing, which is outside a certain area.

BRIEF DESCRIPTION OF THE DRAWINGS

In the following the invention is disclosed with reference to the enclosed drawing, where

FIG. 1 shows a flat 1 and its surrounding formed into a control area. Objects to be controlled in the flat and possibly outside close to it, for instance at a distance less than 100 m, are furnished with a short range standard radio 2 (Std radio) fitted with a transmitter and a receiver. Such a radio can be a Blue-tooth type transmitter/receiver. Each Std radio 2 has its own individual code, from where they are identified as a Std radio connected to flat 1. These radios have programmed in them a safety protocol, thank to which they are, for instance, able to be in current-saving mode, while within the system area. One corresponding, for instance a Blue-tooth type Std radio 3, is located in a central place in the attic of the flat. This Std. Radio 3 is meant as a safety module to monitor the presence of objects to be controlled. If the objects at the end of the range of Std. Radio 3, chosen as safety module, and the safety module 3 perceives it in receiving such a signal from radio 2, the radio has nothing to communicate differing from the normal.

Figures 1, 2:
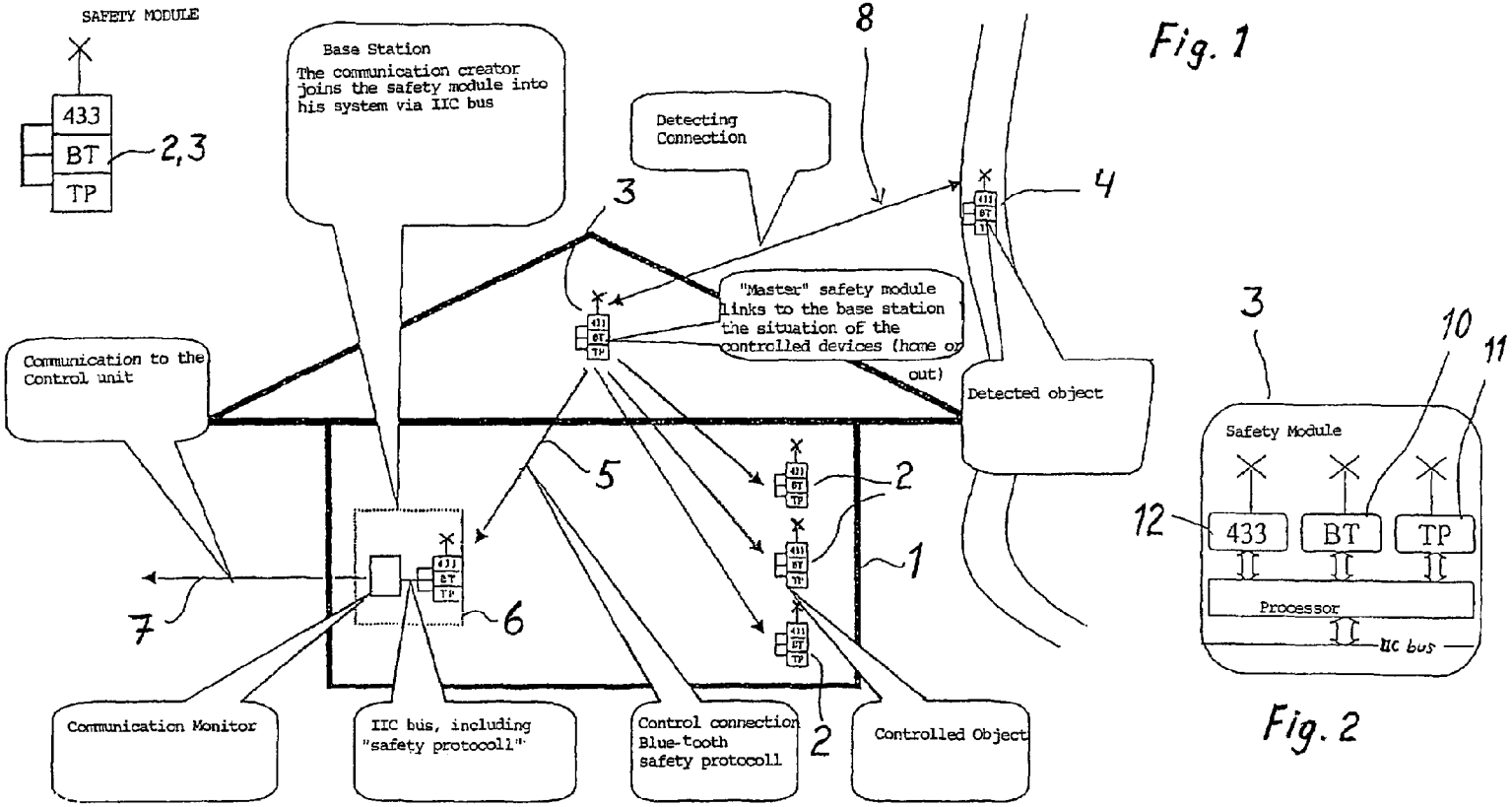
FIG. 1 is a control and detection system according to the invention and connected to a flat.
FIG. 2 is a diagram of an electronic module.

In flat 1 there is a base station 6, from which there is communication to the control centre, which is, for instance, a security for guard duty. From safety module 3 there is controlling contact 5 to the base station. Naturally, they can be located as a common unit.

The objects to be controlled can be fixed objects or mobile objects in the flat furnished with std. Radio 2. If an object or several objects are a mobile object, so taking it out by permission from the area of safety module 3 range, at first to the safety module or base station 6 information about objects to be removed from control must be brought.

Information can be given by a distance-control instrument, for instance. Then the objects can be taken from the area and the system will not react to their missing. Correspondingly, the objects taken from the area by permission will not, in this case, according to their program protocol connected to the radio part, get activated as a transmitter so that they would be considered stolen, if they arrive at the control area of some other cell belonging to the same system.

In returning the objects, they are either recognised as belonging to the cell and taken into control or information is given by distance-control instrument that the objects have been taken again to the control system of flat 1.

In proceeding this way the objects are controlled in the flat 1 area, but "switched of" outside the area.

If the objects are controlled in flat 1 area and the object is taken from the area so that it gets outside the range of safety module 3, according to the safety protocol connected to the radio part of the object, the transmitter of object radio 2 is activated to send its code and possibly alarm data. A situation like this comes into question, when the object is stolen or otherwise lost from the area. Safety module 3 also detects in this case the absence of the object from the flat area. The safety protocol of the safety module steers the safety module to inform this fact to the base station, for instance informing the code and mode "absent" of the absent object. The base station communicates this information to the control centre along line 7.

After this, the control centre of the security knows the object lost and, in addition, the transmitter part of the target is activated to a transmitter. The object is found on arriving at the area of any flat, building or control area joined to the same system and there to range end of the corresponding safety module. The safety module of this area perceives the activated transmitter that does not belong in there and forwards the identification data it has captured, this data ending finally in the control centre. The location of the lost object is thus found out.

When the same control and detection system as per the invention includes a number of control areas covering the whole country, a stolen object or lost object will, before long, get into any such area and found. The communication time of the activated transmitter depends on the power source with it. If the transmitter must rely on its own battery, the operating time is at least a few days. The transmitter can be hidden in a car, boat or, for instance, a computer. In these cases the transmitter receives power from the object itself and the operating time will not become a problem in situations of theft. If the object is hidden in a work of art, weapon, bicycle the operation time of transmitter may be insufficient. In such cases there can be in connection with the transmitter a transponder 11 that from an another electromagnetic field is able to capture energy and by means of this activation of transmitter can be brought about at least into such a mode that the presence of the transmitter in the range area can be detected. Therefore, the frontier stations, at least, should be furnished with transmitters giving energy to the transponders, whereat taking the object out of the country would be detected.

In FIG. 1 a foreign object 4 that must be detected has arrived in the range area 1 of the flat safety module 3 and the detection activity switches on, when transmitter 4 of the object has been activated. From the safety module the identification data of object 4 moves over base station 6 to the control centre.

If, for instance, a object finished with Std. Radio 2 is a weapon and it is stolen, it is possible to join the weapon deactivation into connection with the activation of the transmitter in the weapon, i.e. change-over to an inactive mode. This is done, for instance, building into the weapon a trigger stopper to prevent trigger motion. Then it is impossible to shoot with the weapon without special arrangements. By means of the invention it is possible to go even farther so that one cannot shoot with a gun taken from a police. The police has a safety module 3 in his wrist and the weapon has a transmitter 2. For them a control range of only 30 cm has been chosen. If the weapon is taken farther from the police wrist, it does not trig anymore according to the above presentation. Instead, if the police can get the weapon back, it triggers when the trigger stopper withdraws, when the object enters the safety module range.

The function of a system as per the invention requires a wide range so that there is a sufficient number of fixed and mobile safety modules to detect objects. For instance, the Blue-tooth transmitter/receiver techniques is as a mass-produced article and regarding its range suitable for this purpose. A transmitter of Blue-tooth type must in the above embodiment also program a safety protocol to control the transmitter function when it is receiving signals from the safety module, unable to receive signals from the safety module, receiving signals from foreign transmitters, and the protocol program must include possibilities to control the safety module into activity by different modes, as fixed to object 2, as "master" module 3, or as base module 6. In these also automatic selection of mode can come into question.

FIG. 2 is a safety module with a standard radio, as a Blue-tooth (BT) radio 10, a 433 Hz transceiver unit 12 for detection by bearing and a transponder 11 to capture energy.

Into the processor part the safety protocol program is programmed. The activity in different modes works as following:

- As "master" 3 the safety module transmits automatically data about the presence of modules in the objects to the application in the base station and transmits the commands from the base station to the objects.
- As radio 2 in the object it receives commands, transmitted by the base station, for instance to switch on the detection protocol if the connection to the "master" is cut off.
- As base station device 6 it transmits commands given over the data trans-mission net to the "master" and object modules and transmits data arrived over the "master" to the data transmission net.

It is advantageous that each Blue-tooth, or similar would, when programmed, include a general safety protocol program (IIC bus+radio communication), which would enable taking the product into the control and detection system without any other equipment than an accumulator or a battery.

Another embodiment is that in the object of detection there is a radio transmitter with an individual code (ID) and the use of this radio could be to serve a quite another application. In the object or within the area there is also, at least, one radio listening to the inter-communication of radios in the control objects and not necessarily taking part in the communication among them. The listening radio has data transmission connection to the control centre, thus being the only radio in the respective control environment that serves the system according to this invention. The listening area and can therefore identify foreign radios entering its audible range and transmit respective data to the control centre, not knowing whether they are lost objects or not. The listening radio also knows the code of a control object leaving the audible range by permission and so it does not transmit any message of disappearance.

The codes (ID) of a radio disappeared from the control object and of any other disappeared unknown radio, which has entered the audible range of the control object, meet in the control centre, where, in the case in question, the exact location of the disappeared radio of that moment is known. The system works by radios using any frequency or any kind of data transmission and the methods of which are known by the listening radio of the control object. As a typical example the Blue-tooth devices may be mentioned. The control centre combines the codes of radios announced to be disappeared and of those announced to be foreign for the control unit and produces from them alarm and location data.

The listening radio can be in mobile use having then no control objects of its own, further, it can be furnished with an own location data system in order to determine its location. It can also work without connection with the control centre, locally producing data of its control objects within its control area. Listening radios are connected to one or several control centres, which process all data from the radios and produces location data with the accuracy of audible range of the radio.

On using a listening radio in a system according to the invention base stations of communication are not necessarily required, but the radio can have direct contact to the control centre.

Many modifications of the invention are possible within the inventive concept determined by the enclosed claims.

The invention claimed is:

1. A control and detection system for control of one or more objects connected the system, and for detection of location of the object in case the object disappears comprising a communication system for communicating from each object to at least to one data receiving device, and from said receiving device via data transmission to a control unit and further comprising an active short range transmitter that can be activated for functioning with a unique code and being placed in said object in the control area, said system comprising:

a safety module, as a listening radio, monitoring at a distance of short range (10–100 m) the presence of the transmitter placed in said object in the area and/or detecting said object arriving to the area, wherein the safety module of each local cell, formed of the safety module, base station and objects connected to the base station is arranged to detect the arrival of any other active transmitter in the short range in order to identify the other active transmitter and forward respective data to the control unit, communication between said safety module radio and the control unit either directly or via a base station and a program in said safety module which steers the communication in a safety use, and in control situation to detect a distance between the safety module and the object which is smaller than the range of communication between said safety module and said object.

2. The system according to claim 1 wherein landing of the object outside the range with regard to said safety module causes activation of said transmitter in the object in order to transmit signals.

3. The system according to claim 1 wherein said system comprises several local cells, as a dwelling-house including valuables, an arms trade including weapons and a garage including cars, formed of the safety module and the base station with objects connected to the base station.

4. The system according to claim 1 wherein when the safety module looses its control connection to the object, because the object is now outside the range, the safety module gives an alarm signal to the control unit.

5. The system according to claim 1, wherein to the safety module, data must be given about those objects in the cell, the exit of which from the area is allowed without alarm.

6. The system according to claim 1 wherein, by means of a fixed or mobile cell in the system, a disappeared or stolen object can be detected, when the transmitter in the object is activated and has reached the range end reckoned from cell in the system.

7. The system according to claim 1 wherein to the transmitter in the object, an additional function for object protection and with impact on its operation is connected.

8. The system of claim 7, wherein said additional function is provided by a trigger stopper in a weapon having a trigger function of a color cartridge by money delivery.

9. A system according to claim 1 wherein an object furnished with an activated transmitter can be detected on the basis of station data about a cell, to which area the object has entered.

10. The system according to claim 1 wherein the objects are controllable and detectable by means of a safety module, said module connectable to at least one of the objects and to a control or detection unit, said safety module comprising a Blue-tooth type transmitter/receiver and a protocol program for controlling its function at least in safety module use.

11. The system according to claim 10 wherein, to the safety module, as energy source, a transponder and as a transmitter, a transceiver has been connected.

12. The system of claim 11, wherein the transceiver transmits at 433 Hz.

13. The system of claim 1, wherein said transmitter comprises a Blue-tooth transmitter.

* * * * *